United States Patent [19]

Burns et al.

[11] 4,384,529

[45] May 24, 1983

[54] PROJECTILE SEAL

[75] Inventors: Bruce P. Burns, Churchville; William F. Donovan, Aberdeen, both of Md.

[73] Assignee: The United States of America as represented by the Secretary of the Army, Washington, D.C.

[21] Appl. No.: 230,785

[22] Filed: Feb. 2, 1981

[51] Int. Cl.[3] ..... F42B 31/00

[52] U.S. Cl. ..... 102/525; 102/520; 102/703

[58] Field of Search ..... 102/520–528, 102/703

[56] References Cited

U.S. PATENT DOCUMENTS

| | | | |
|---|---|---|---|
| 160,569 | 3/1875 | Butler | 102/525 |
| 193,657 | 7/1877 | Hotchkiss | 102/525 |
| 3,439,620 | 4/1969 | Crossley et al. | 102/527 |
| 3,910,194 | 10/1975 | Dehm et al. | 102/527 |
| 4,040,359 | 8/1977 | Blajda et al. | 102/527 |

FOREIGN PATENT DOCUMENTS

| | | | |
|---|---|---|---|
| 67194 | 3/1940 | Czechoslovakia | 102/520 |

*Primary Examiner*—Harold J. Tudor

*Attorney, Agent, or Firm*—Nathan Edelberg; Robert P. Gibson; Max Yarmovsky

[57] ABSTRACT

A wedge-shaped seal for sealing against leakage of gun gases past a projectile in the bore of a gun barrel includes a wedge-shaped tip having rearward angled forward and rear surfaces which is preloaded to bear the tip against the projectile body. A wedge-shaped region between the lip and the projectile body is partly collapsed by the pressure of gun gases on the rear surface of the lip to improve the seal. A similar seal may be provided with the bore of the gun barrel.

11 Claims, 3 Drawing Figures

FIG. 1
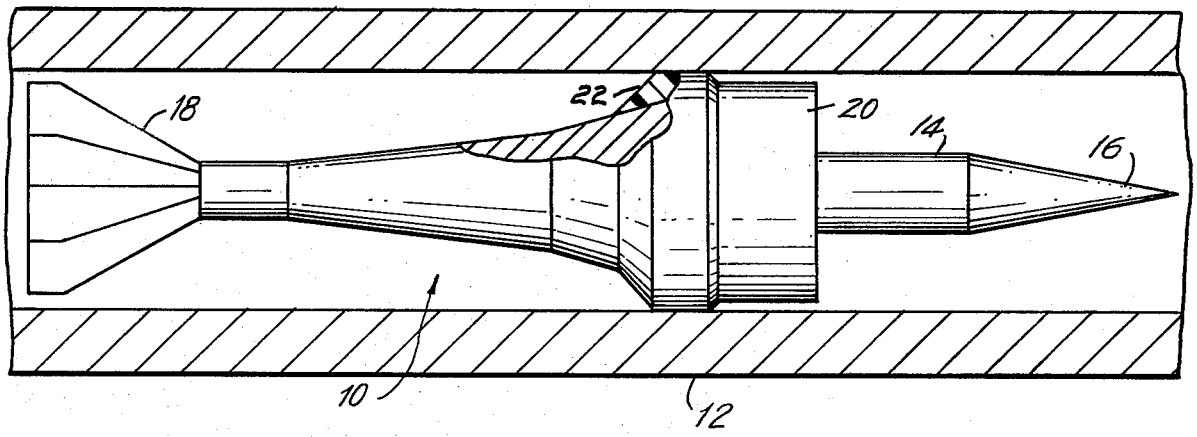
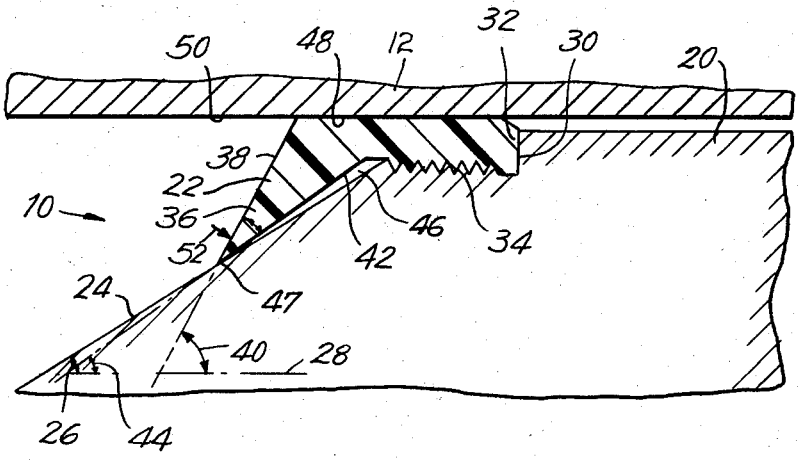
FIG. 2
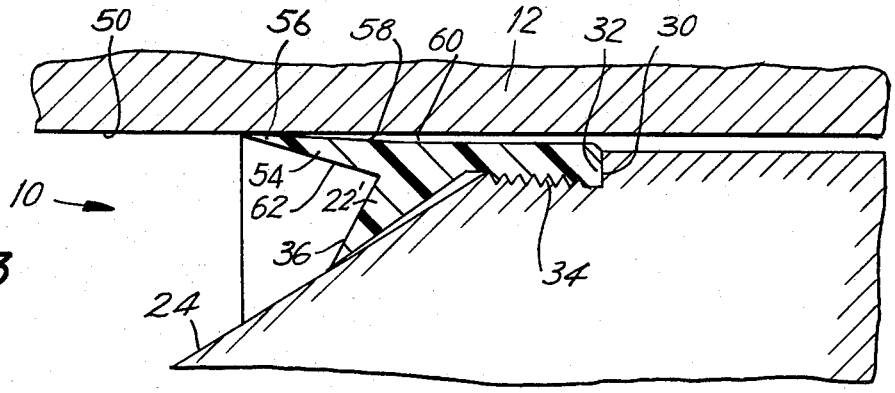
FIG. 3

PROJECTILE SEAL

GOVERNMENT INTEREST

The invention described herein may be manufactured, used and licensed by or for the Government for governmental purpose without the payment to us of any royalties thereon.

BACKGROUND OF THE INVENTION

The present invention relates to a sealing element for sealing a projectile against the leakage of gases there past.

More particularly, the present invention is related to providing a seal for a ballistic projectile to prevent erosion and/or failure of the interior ballistics propulsion system during the barrel travel phase of projectile launch.

When a projectile is launched in a gun barrel, it acquires its initial velocity from the propulsive effect of the gun propellant gas pressure. The gas pressure is applied over the cross sectional area of the projectile which is defined by the effective projectile diameter taken at some contact circumference along the bore of the barrel which corresponds to the sealing surface of the projectile.

If the projectile is of a material which may be deformed slightly by action of the gun gases upon it, the radial deformation of the projectile body may be employed to form the seal between itself and the gun bore. In order to improve the seal, almost all conceivable types of soft deformable materials have been used to seal the finite gap between the projectile and the barrel. Such materials have included cloth, paper, elastomeric materials, and various metals such as lead, copper and aluminum. The geometric deformation of the seal may be elastic and/or plastic.

One common method of providing a seal includes the manufacture of a shell having a circumferential groove therein into which a circular band of relativley soft metal is inserted by elastic stretching, plastic swaging or by welding/brazing methods. A commonly used material is gilding metal which is swaged in place. Gilding metal is an alloy of 95 percent copper and 5 percent zinc.

A need exists for a seal which will permit improved performance under more restricted and sophisticated design requirements.

OBJECTS AND SUMMARY OF THE INVENTION

Accordingly, it is an object of present invention to provide a seal for a gun launched projectile which overcomes the drawbacks of the prior art.

More specifically, it is an object of the present invention to provide a seal which employs unsupported areas permitting collapse of portions of the seal against the projectile and/or the gun barrel for providing a sealing area.

According to an aspect of the invention there is provided a seal for sealing a gun launched ballistic projectile against leakage of gun gases past the projectile while the projectile is accelerated in a barrel of a gun, comprising at least one rearward-directed lip on the seal, the lip having a rear surface and a forward surface, the rear surface and the forward surface intersecting in a tip, means for affixing the seal to the projectile and for preloading the tip against a contact surface of one of the barrel and the projectile, the forward surface forming an unsupported semiconical frustum space with the contact surface when the seal is not acted upon by gun gases, and the lip being effective to permit partial collapse thereof when the rear surface is exposed to gun gases whereby an additional portion of the forward surface is urged into sealing contact with the contact surface to provide a substantially gas-tight seal therebetween.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a cross section of a gun barrel showing a projectile therein in partial cross section.

FIG. 2 shows an enlarged cross section of a seal area of the projectile of FIG. 1 showing a seal according to an embodiment of the invention.

FIG. 3 is an enlarged cross section showing a seal according to a second embodiment of the invention.

DETAILED DESCRIPTION OF THE PREFERRED EMBODIMENT

Referring now to FIG. 1, a projectile 10 is shown in an intermediate position in the barrel 12 of a gun. Barrel 12 may be rifled or smooth bore and projectile 10 may be a monolithic bullet or a flechette round including a sabot. For concreteness of description projectile 10 is illustrated to include a dart-shaped flechette 14 having a pointed nose 16 and a plurality of guidance fins 18. A sabot 20 encases the center of flechette 14 to seal barrel 12 and to guide flechette 14 during its travel through barrel 12 to the muzzle (not shown). As is well known, sabot 20 is peeled away from flechette 14 in petal fashion by aerodynamic forces as projectile 10 leaves barrel 12.

A seal member 22 is employed at the rear of sabot 20 to seal against gas pressure behind projectile 10 escaping along the barrel past sabot 20 and being wasted.

Referring now to FIG. 2, sabot 20 is seen to include a boat tail 24 making an acute angle 26 with respect to an axis 28 of barrel 12. Sabot 20 includes an abutment surface 30 against which a forward surface 32 of seal member 22 is pressed by engagement of a threaded connection 34 between sabot 20 and seal member 22.

A lip 36 at the rear of seal member 22 has an inward angled rear surface 38 which extends from barrel 12 to contact boat tail 24. Rear surface 38 makes an angle 40 with respect to axis 28. A forward surface 42 of lip 36 makes an angle 44 which is larger than angle 26 of boat tail 24. Thus, a wedge-shaped space 46 is formed between forward surface 42 and boat tail 24. Lip 36, in its unstressed condition shown in FIG. 2 touches boat tail 24 only at its tip 47 or, at most, along a short portion of forward surface 42 adjacent tip 47. An annular outer surface 48 of seal 22 contacts the bore 50 of barrel 12 to provide sealing against gases bypassing seal 22.

As is well known, pressurized gases act normal, or at right angles to surfaces to which they are exposed. Thus, rear surface 38 is acted upon by gun gases in the direction of an arrow 52. Under the influence of such gases, lip 36 is deformed toward boat tail 24 so that more of forward surface 42 of lip 36 is pressed into contact with boat tail 24 to provide a good seal against the passage of gases along boat tail 24 which could otherwise escape between abutment surface 30 and forward surface 32. Thus, instead of a relatively small area of contact in the unpressurized case shown in FIG. 2, a relatively large tight area seal is produced.

The embodiment of the invention shown in FIG. 2, wherein seal 22 is affixed to sabot 20 by a threaded connection may be employed as a rotating band as well as a seal to impart spin (torque) to projectile 10 when used in a rifled barrel. When used in a smooth bore, seal 22 acts solely as a obturator merely to provide a seal between the projectile and the barrel. It would be clear to one skilled in the art, that, even in a rifled barrel, relative rotation between sabot 20 and seal 22 may be permitted to thus reduce the ultimate spin rate of projectile 10.

The total pressure forcing forward surface 42 into contact with boat tail 24 is equal to the prestress pressure resulting from assembly using threaded connection 34 plus the pressure resulting from gas pressure acting normal to rear surface 38 amplified by any unbalanced seal area where lip 36 does not collapse against boat tail 24.

A further embodiment of the invention is shown in FIG. 3 wherein a second lip 54 is provided on a seal 22' in addition to a lip 36 which corresponds to the lip in FIG. 2 and will not be further described.

Second lip 54 extends outward to contact bore 50 at its tip 56. In a manner similar to that of lip 36, a forward surface 58 of lip 54 is angled away from tip 56 to provide a generally wedge-shaped gap 60. In a manner similar to that previously described, when gun gases act normal to the rear surface 62, lip 54 tends to collapse against bore 50 to provide a relatively large sealing surface.

Seals 22 and 22' may be of any suitable plastic material such as Nylon, teflon, polyvinyl chloride, cellulose acetate, or metals such as copper or aluminum, or reinforced composites such as glass microspheres in teflon, chopped glass roving in Nylon.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

We claim:

1. An annularly shaped seal member for sealing a gun launched ballistic projectile against leakage of gun gases past the projectile boat tail while the projectile having a boat tail is accelerated in a barrel of a gun, comprising:

at least one rearward-directed lip on said seal member, said lip having a rear surface and a forward surface, said rear surface and forward surface intersecting in a tip, said forward surface making an angle with repect to the longitudinal axis of the projectile which is larger than the angle of said projectile boat tail, with respect to said axis, said lip touching said boat tail only at said tip prior to projectile launch, said forward surface forming a wedge-shaped space between said forward surface and said boat tail when said seal member is not acted upon by said gun gases;

means for affixing said seal member to said projectile and for preloading said lip against contact surfaces of said barrel and said projectile boat tail which includes;

a forward abutment surface of said annular seal member;

an internally threaded section of said seal member disposed intermediate said forward abutment surface and said tip, said seal member threadedly attached to said projectile to press said forward abutment surface of said seal member against an abutment surface of said projectile; and said lip being effective to permit partial collapse thereof when said rear surface is exposed to gun gases whereby an additional portion of said forward surface is urged into sealing contact with said contact surfaces to provide a substantially gas-tight seal therebetween.

2. A seal according to claim 1 wherein said at least one rearward-directed lip includes a first rearward-directed lip having a tip preloaded against a first contact surface of said projectile and a second rearward-directed lip having a tip preloaded against a second contact surface of said gun barrel.

3. A seal according to claim 1 wherein said seal includes means for transmitting torque derived therein from rifling in said barrel to said projectile.

4. A seal according to claim 1 wherein said seal is plastic.

5. A seal according to claim 4 wherein said plastic is Nylon.

6. A seal according to claim 4 wherein said plastic is teflon.

7. A seal according to claim 4 wherein said plastic is polyvinyl chloride.

8. A seal according to claim 4 wherein said plastic is cellulose acetate.

9. A seal according to claim 1 wherein said seal is metal.

10. A seal according to claim 1 wherein said seal is a reinforced composite.

11. A seal according to claim 1 wherein said contact surface includes a boat tail on said projectile, said boat tail making an acute angle with an axis of said projectile and said forward surface making an angle with said axis which is greater than said acute angle.

* * * * *

UNITED STATES PATENT AND TRADEMARK OFFICE

CERTIFICATE OF CORRECTION

PATENT NO. : 4384529

DATED : May 24, 1983

INVENTOR(S) : Bruce P. Burns, Churchville; William F. Donovan, Aberdeen; both of Md.

It is certified that error appears in the above—identified patent and that said Letters Patent is hereby corrected as shown below:

ON THE TITLE PAGE,

INVENTOR(S): Bruce P. Burns, Churchville; William F. Donovan, Aberdeen; James O. Pilcher, Edgewood, all of Md.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*